US006881117B2

(12) United States Patent
Huang et al.

(10) Patent No.: US 6,881,117 B2
(45) Date of Patent: Apr. 19, 2005

(54) METHOD FOR MANUFACTURING BUS ELECTRODES OF PLASMA DISPLAY PANEL

(75) Inventors: Wen-Rung Huang, Tainan (TW); Cheng-Min Chen, Chilung (TW); Ching-Chung Cheng, Ping Chen (TW); Shun-An Lin, Pa Te (TW)

(73) Assignee: Chunghwa Picture Tubes, Ltd. (TW)

( * ) Notice: Subject to any disclaimer, the term of this patent is extended or adjusted under 35 U.S.C. 154(b) by 196 days.

(21) Appl. No.: 10/407,252

(22) Filed: Apr. 7, 2003

(65) Prior Publication Data

US 2004/0147196 A1 Jul. 29, 2004

(30) Foreign Application Priority Data

Jan. 29, 2003 (TW) ..... 92102052

(51) Int. Cl.[7] ..... H01J 9/00; H01J 9/02; H01J 9/14

(52) U.S. Cl. ..... 445/24; 430/312; 430/319; 430/321

(58) Field of Search ..... 430/312, 319, 430/321; 445/24

(56) References Cited

U.S. PATENT DOCUMENTS 5,851,732 A * 12/1998 Kanda et al. ..... 430/321
6,156,433 A * 12/2000 Hatori et al. ..... 430/312
6,333,140 B1 * 12/2001 Hatori et al. ..... 430/312
6,355,402 B1 * 3/2002 Ahn ..... 445/24
6,555,594 B1 * 4/2003 Fukushima et al. ..... 315/169.3
6,613,636 B1 9/2003 Wada et al.

* cited by examiner

*Primary Examiner*—Mariceli Santiago

(57) ABSTRACT

A bus electrode of the present invention is formed by first coating a Ru-containing layer on the front plate and the transparent electrodes. Then, an Ag-containing layer is coated over the Ru-containing layer. In accordance with the present invention, the coating area of the Ru-containing layer is larger than the coating area of the Ag-containing layer to improve adhesion between the bus electrodes, glass plate and the transparent electrodes. Then, a photolithography process is performed to define the bus electrodes.

14 Claims, 8 Drawing Sheets

METHOD FOR MANUFACTURING BUS ELECTRODES OF PLASMA DISPLAY PANEL

BACKGROUND OF THE INVENTION

1. Field of Invention

The present invention relates to a plasma display panel, PDP, and more particularly to a method for manufacturing bus electrodes of a plasma display panel.

2. Description of Related Art

Plasma display panels (PDP) can be divided into two types, the direct current (DC) type and the alternating current (AC) type, according to their electrical driving mode. In FIG. 1, which illustrates a conventional AC-type PDP, glass plates 11, 12 undergo several manufacturing steps in which many functional layers are formed thereon and are then combined together by sealing the periphery of the glass plates 11, 12. A mixed gas with a predetermined ratio is then introduced into the discharge units between the glass plates 11, 12.

In FIG. 1, a plurality of parallel transparent electrodes 111 and bus electrodes 112, a dielectric layer 113 and a protective layer 114 are sequentially formed on the glass plate 11, hereinafter referred to as front plate 11. Similarly, a plurality of parallel address electrodes 121, a plurality of parallel barrier ribs 122, a fluorescencer 123 and a dielectric layer 124 are formed on the glass plate 12, hereinafter referred to as back plate 12. It is noticed that the barrier ribs 122 can be formed as grid structure. One transparent electrode 111 on the front plate 11 and one address electrode 121 on the back plate 12, transparent electrode 111 and address electrode 121 being perpendicularly crossed, compose a discharge unit. When a voltage is applied to a specific discharge unit, gas discharge occurs at the discharge unit between the dielectric layers 113 and 124 to induce emission of a colored visible light from the fluorescencer 123.

FIG. 2 is a schematic, cross-sectional view corresponding to FIG. 1. In a conventional AC-type PDP 10, referring to FIGS. 1 and 2 simultaneously, a plurality of parallel-arranged transparent electrodes 111 are formed on the front plate 11. Each of the transparent electrodes 111 correspondingly has a bus electrode 112 to reduce linear resistance of the transparent electrodes 111. In one discharge unit 13, a three-electrode structure, including an X electrode and an Y electrode of the transparent electrode 111 on the front plate 11 and an address electrode 121 on the back plate 12, is generally employed. When a voltage is applied to the above three electrodes of a specific discharge unit 13 to induce discharge, the mixed gas in the discharge unit 13 emits ultraviolet (UV) rays to light the fluorescencer 123 inside the discharge unit 13. The fluorescencer 123 then emits a visible light, such as a red (R), green (G) or blue (B) light. An image is thus produced by scanning the discharge unit array.

FIG. 3 is a schematic, top view of the front plate 11 of the conventional AC-type PDP 10. A pair of transparent electrodes 111 arranged in parallel is shown in this figure. A plurality of transparent electrodes 111 arranged in parallel are built in the front plate 11. The transparent electrodes 111 have a higher resistance; therefore, a plurality of bus electrodes 112 is formed over the corresponding transparent electrodes 111 to help discharge and reduce the resistance of the transparent electrodes 111. The part of the bus electrodes 112 indicated by the number 300 and 302 extend out the transparent electrodes 111 to connect with the control circuit (not shown in the figure) to control the discharge of the transparent electrodes 111.

Two coating processes are used to form the bus electrodes 112 as shown in the FIG. 4. First, a Ru-containing layer 40 is coated on the front plate 11 and the transparent electrodes 111. Then, an Ag-containing layer 42 is coated over the Ru-containing layer 40. The Ru-containing layer 40 is used to help the Ag-containing layer 42 to adhere over the transparent electrodes 111. Referring to FIG. 5A, a photolithography process is performed to define the bus electrodes 112. Next, a dielectric layer 113 is formed on the front plate 11 to cover the transparent electrodes 111 and bus electrodes 112. A protective layer 114 is formed on the dielectric layer 113.

However, the difference in material characteristics between the Ru-containing layer 40 and the Ag-containing layer 42 causes a beveled edge in the defined bus electrodes 112. The defined bus electrodes 112 are shown in the FIG. 5B, which is an enlargement of FIG. 5A. The width (x direction) and the length (z direction) of the Ru-containing layer 40 are both less than the width and length of the Ag-containing layer 42. In other words, the area in the x-z plane of the Ru-containing layer 40 is less than the area in the x-z plane of the Ag-containing layer 42. It is very possible for the Ag-containing layer 42 to peel away from the Ru-containing layer 40 in the z direction at the two ends of the bus electrodes 112.

A thermal process is often performed during manufacturing the dielectric layer 113. Because of the stress resulting from the thermal process, peeling may occur at the beveled edge in the bus electrodes 112. However, the peeling is suppressed in this part of the bus electrodes covered by the dielectric layer 113. Therefore, the extension 300 and 302 of the bus electrodes as shown in FIG. 3 often break because of peeling.

FIG. 6 shows a cross-sectional view of FIG. 5 from the AA' line. The difference in material characteristics between the Ru-containing layer 40 and the Ag-containing layer 42 sometimes cause a beveled edge in the bus electrodes 112. The part 600 extending out of the dielectric layer 113 often causes peeling because of thermal stress. Serious peeling causes the bus electrodes 112 to break. Extended part 600 is used to connect with the control circuit (not shown in the figure); however, the panel cannot be connected to the control circuit once the extended part 600 breaks.

SUMMARY OF THE INVENTION

According to the above descriptions, the conventional manufacturing method of the plasma display panel often causes the extended parts of the bus electrodes break. Such break result in a panel that cannot connect with the control circuit. Therefore, the present invention provides a bus electrodes manufacturing method of a plasma display panel to resolve the peeling situation described above.

The main purpose of the present invention is to provide a manufacturing method of the bus electrodes in the front plate. In accordance with the method of the present invention, the coating area of the Ru-containing layer is larger than the coating area of the Ag-containing layer when manufacturing the bus electrodes over the transparent electrodes. The area difference makes the length of the Ru-containing layer longer than or equal to the length of the Ag-containing layer in the extended part after photolithography process. Such manufacturing method avoids the Ag-containing layer extending out the Ru-containing layer. The Ag-containing layer is preferably adhered to the transparent electrodes because of the longer Ru-containing layer. Therefore, the part of the bus electrodes extending out from the transparent electrodes avoid the peeling situation.

In accordance with the preferably embodiment of the present invention, a Ru-containing layer is coated on the front plate and the transparent electrodes first when manufacturing a bus electrodes over the front plate. Then, an Ag-containing layer is coated over the Ru-containing layer. In accordance with the present invention, the coating area of Ru-containing layer is larger than the coating area of the Ag-containing layer. Then, a photolithography process is performed to define the bus electrodes. A part of the Ru-containing layer is not covered by the Ag-containing layer when coating the Ag-containing layer. In other words, the coating length of the Ru-containing layer is longer than the coating length of the Ag-containing layer. Therefore, even though the etching rate of the Ru-containing layer is higher than the Ag-containing layer, the length of the Ru-containing layer is still greater than or equal to the length of the Ag-containing layer in the part of extending out the transparent electrodes after the photolithography process to define the bus electrodes. The Ag-containing layer is preferably adhered to the transparent electrodes because of the longer Ru-containing layer.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENTS

Without limiting the spirit and scope of the present invention, the manufacturing method proposed in the present invention is illustrated with one preferred embodiment. Skilled artisans, upon acknowledging the embodiments, can apply the manufacturing method of the present invention to any kind of plasma display panel.

In accordance with the present invention, a Ru-containing layer is first coated on the front plate and the transparent electrodes. Then, an Ag-containing layer is coated over the Ru-containing layer. In accordance with the present invention, the coating area of the Ru-containing layer is larger than the coating area of the Ag-containing layer to improve adhesion between the bus electrodes, glass plate and the transparent electrodes. Then, a photolithography process is performed to define the bus electrodes.

Both sides of the Ru-containing layer are not covered by the Ag-containing layer when coating on the Ag-containing layer. In other words, the coating length of the Ru-containing layer is greater than the coating length of the Ag-containing layer. The area difference makes the length of the Ru-containing layer longer than or equal to the length of the Ag-containing layer in the extended part after photolithography process. Such manufacturing method avoids the Ag-containing layer extending beyond the Ru-containing layer. The Ag-containing layer is preferably adhered to the transparent electrodes because of the longer Ru-containing layer. Therefore, the part of the bus electrodes extending out from the transparent electrodes avoid peeling.

A preferred embodiment is described in the following to introduce the application of the present invention. The application of the present invention is not limited by the following description.

Figure 1:
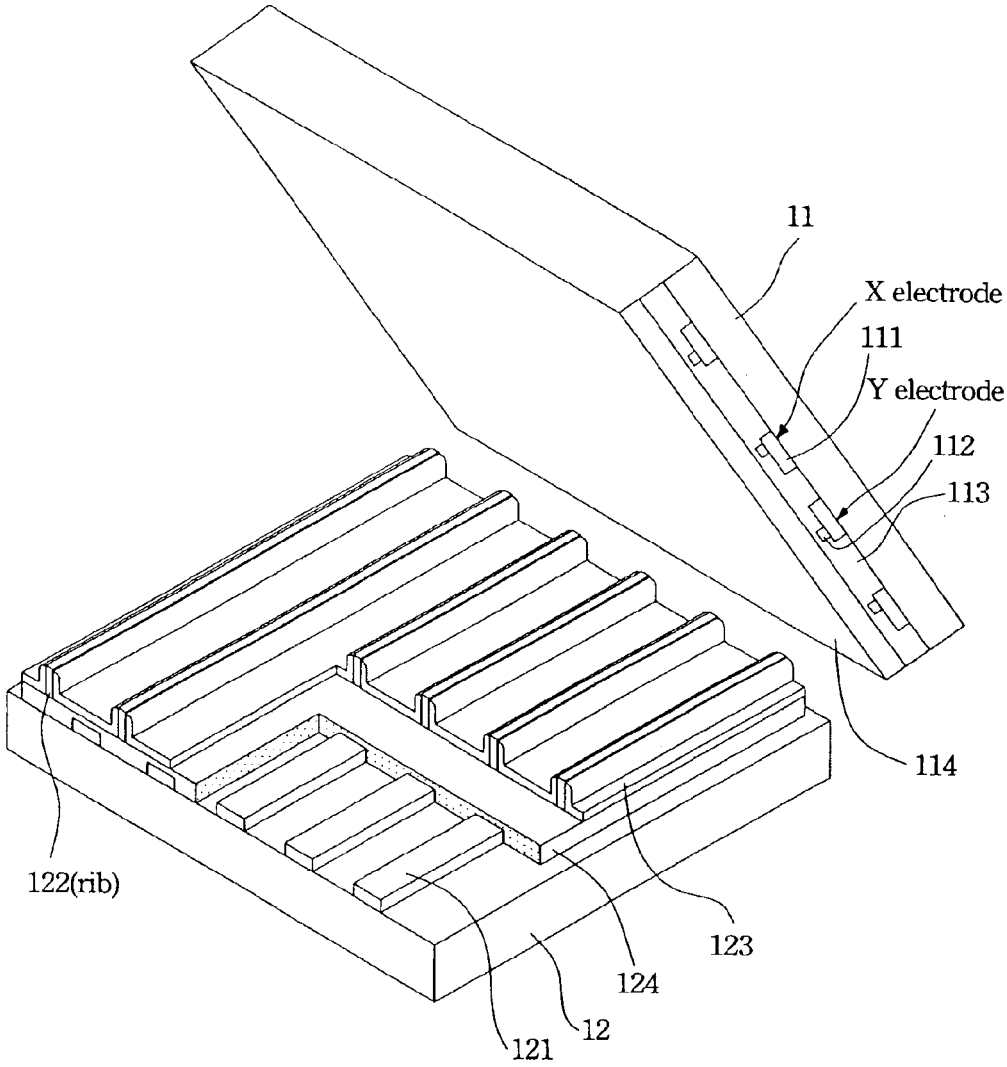
FIG. 1 is a schematic assembly diagram of a front plate and a back plate of a conventional plasma display panel.
Figure 2:
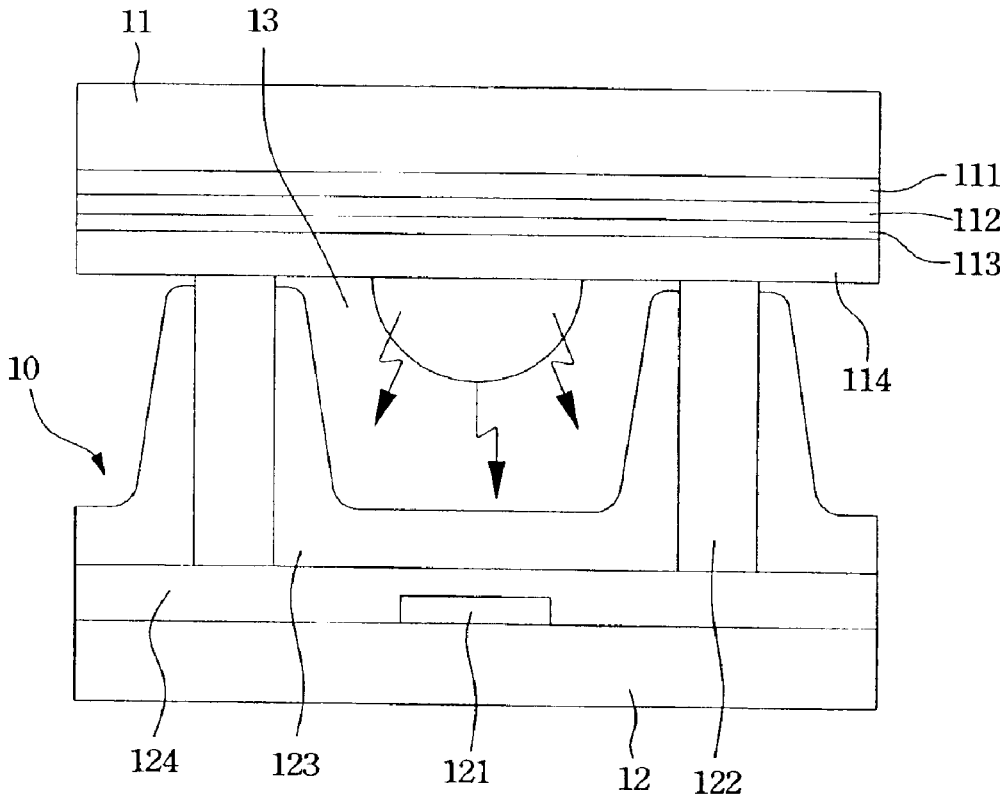
FIG. 2 is a schematic, cross-sectional view of a conventional plasma display panel.
Figure 3:
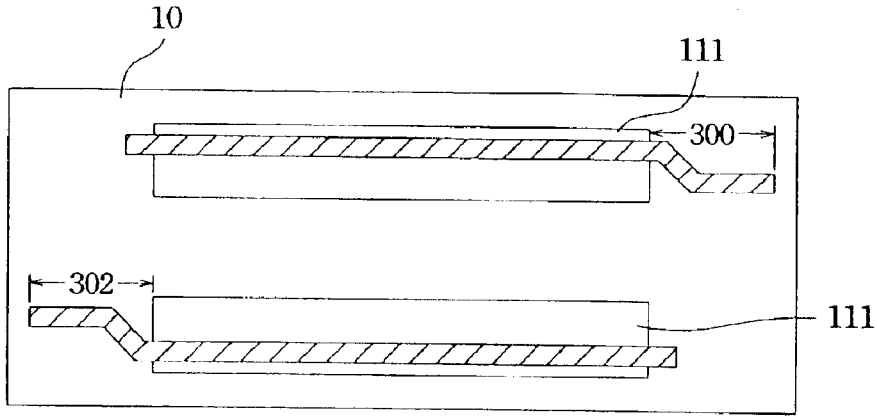
FIG. 3 is a schematic top view of the front plate in a conventional plasma display panel.
Figure 4:
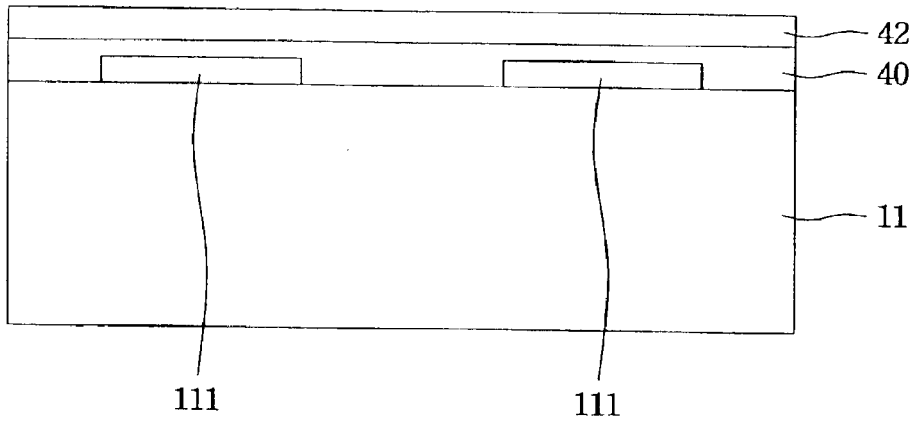
FIG. 4 is a diagram illustrating bus electrode formation over the front plate and the transparent electrodes in accordance with the conventional manufacturing method.
Figure 5A:
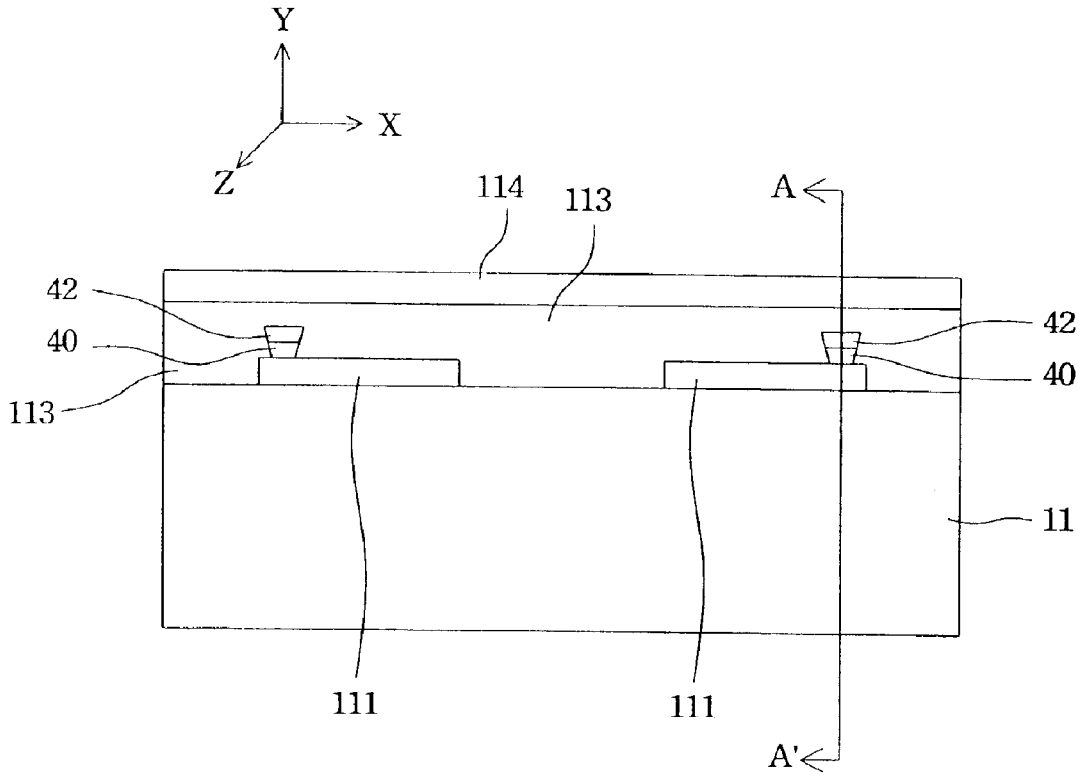
FIG. 5A is a schematic, cross-sectional view of a front plate of a plasma display panel diagram after performing a photolithography process to define the bus electrodes.

FIG. 1 is, as stated earlier, a schematic assembly diagram of a front plate and a back plate of a conventional plasma display panel. The plasma display panel (PDP) of the present invention at least comprises a front substrate 11 and a back substrate 12. On the inside surface of the front substrate 11, a plurality of parallel-arranged transparent electrodes 111, including an X electrode and an Y electrode, is formed. Each transparent electrode 111 has a bus electrode 112 thereon. A dielectric layer 113 is formed on the front substrate 11 to cover the transparent electrodes 111 and bus electrodes 112. A protective layer 114 is formed on the dielectric layer 113. When the substrates 11, 12 are combined together and the steps of vacuuming and refilling with mixed gas having a determined mixed ratio of special gas, such as He, Ne, Ar, or Xe, are completed, the address electrodes 121 on the back substrate 12 and the transparent electrodes 111 on the front substrate 11 are perpendicularly crossed to form the corresponding discharge units.

Figure 7A:
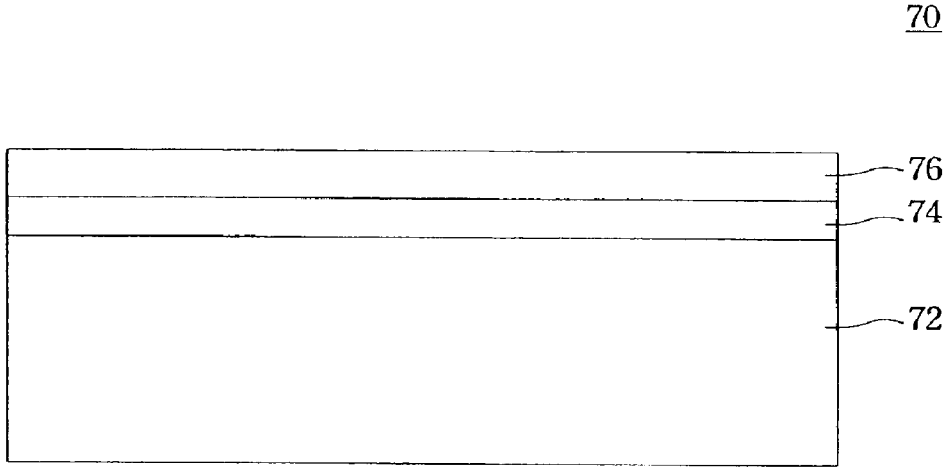
FIG. 7A is a schematic diagram of a glass substrate with an ITO thin film used in the present invention.
Figure 7B:
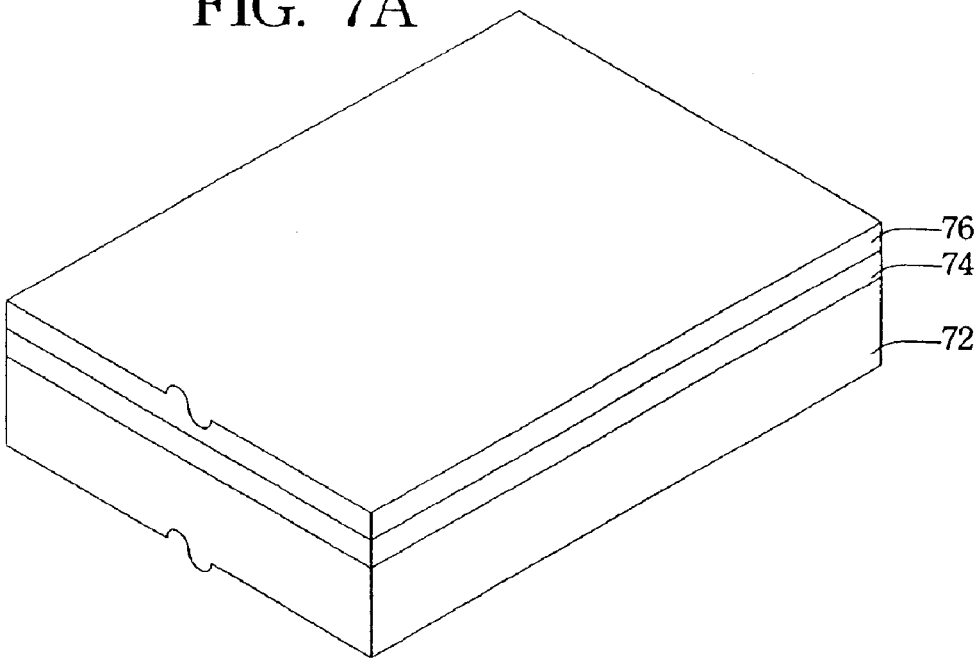
FIG. 7B is a schematic side view of FIG. 7A.

FIG. 7A is a schematic diagram of a glass substrate with an ITO thin film used in the present invention. FIG. 7B is a schematic, side view of FIG. 7A. The glass substrate is composed of a transparent plate 72 and an ITO layer 74. The material of the transparent plate 72 is, for example, glass or quartz. The ITO layer 74 is used as the transparent electrodes of the plasma display panel. The manufacturing method of the transparent electrodes is described in the following.

When manufacturing the transparent electrodes, a photoresist layer 76 is first formed over the ITO layer 74. Then, a photomask is used to define the transparent electrodes pattern in the photoresist 76. This defined photoresist 76 is used as the mask to etch the ITO layer 74 to expose the transparent plate 72. Either a dry etching method or a wet etching method can be used in this etching step. Next, the photoresist 76 is removed.

Figure 8A:
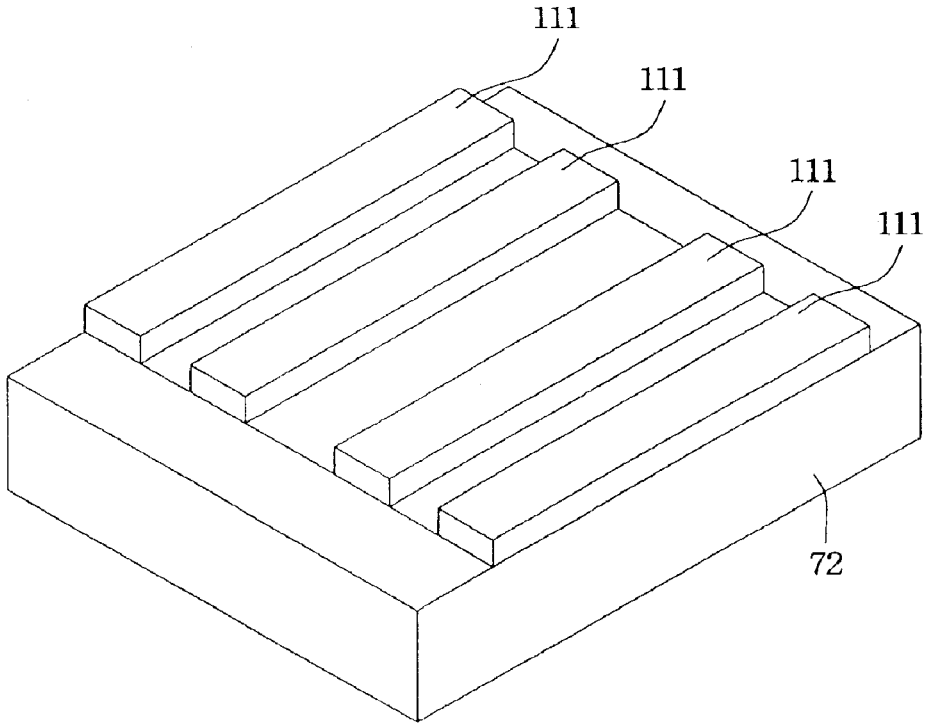
FIG. 8A is a schematic diagram of forming transparent electrodes over a glass substrate with an ITO thin film in accordance with the present invention.
Figure 8B:
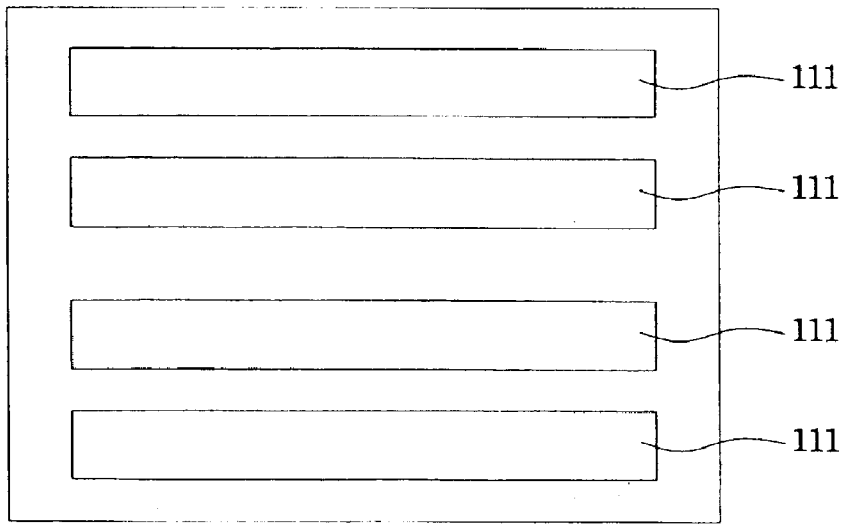
FIG. 8B is a schematic, top view of FIG. 8A.

FIG. 8A shows a schematic diagram of the transparent electrodes 111 formed over the transparent plate 72 in accordance with the present invention. The transparent electrodes 111 are arranged in parallel to each other, including an X electrode and an Y electrode. FIG. 8B is a schematic, top view of FIG. 8A.

Figure 6:
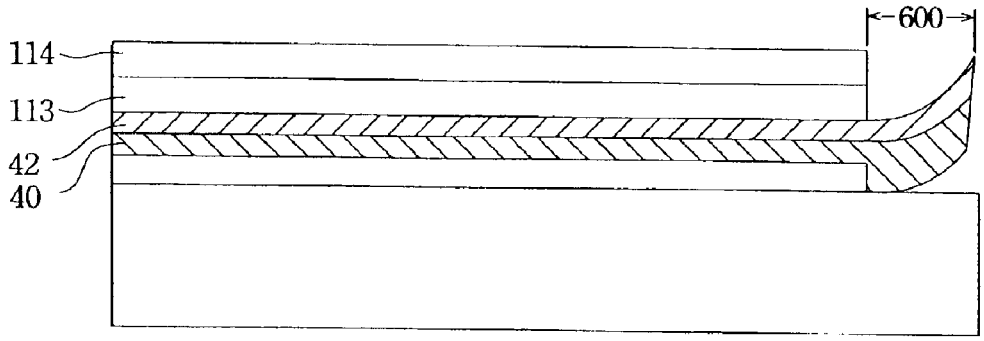
FIG. 6 shows peeling of a bus electrodes.
Figure 5B:
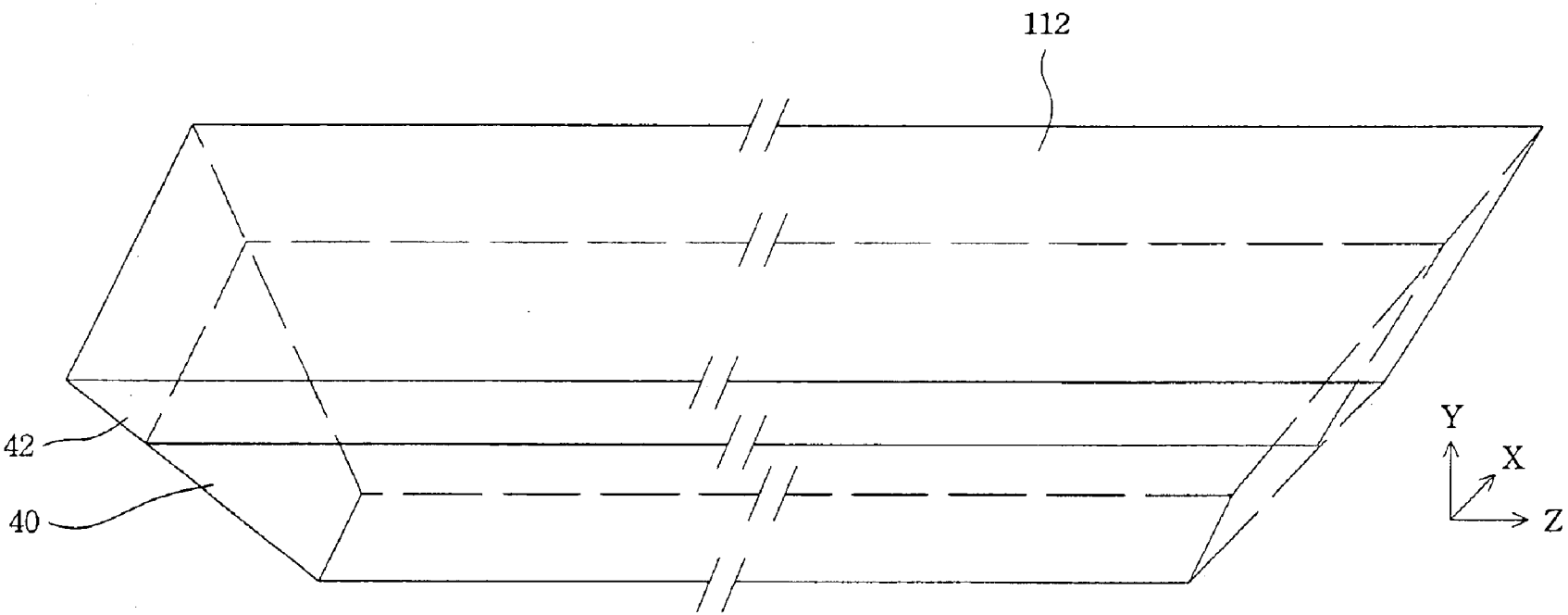
FIG. 5B is an enlarged diagram of the bus electrodes shown in FIG. 5A.
Figure 9A:
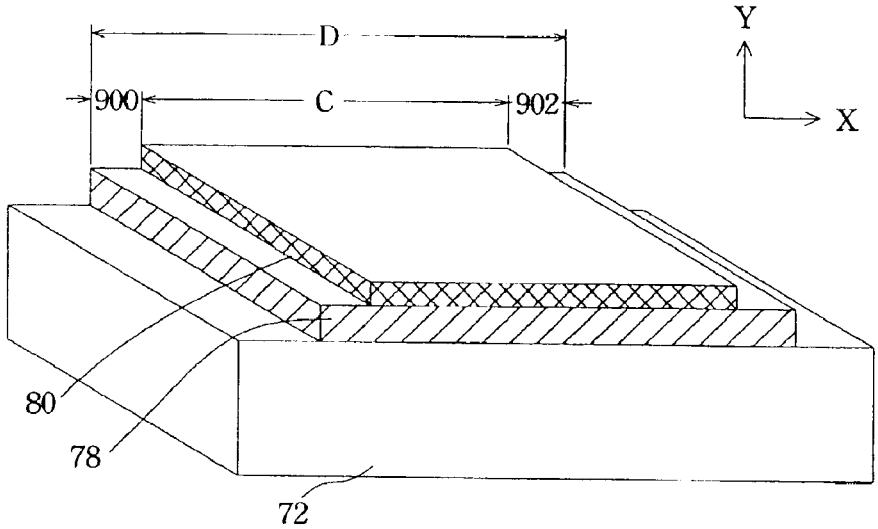
FIG. 9A is a schematic diagram illustrating bus electrode formation over transparent electrodes in accordance with the present invention.

Next, the bus electrodes are manufactured after finishing the transparent electrodes. In accordance with the preferred embodiment of the present invention, the bus electrodes are composed of the Ru-containing layer and the Ag-containing layer. A coating method is used to manufacture the bus electrodes. FIG. 9A is a schematic diagram of forming bus electrodes over transparent electrodes in accordance with the present invention. In accordance with the preferably embodiment of the present invention, a Ru-containing layer 78 is coated on the transparent plate 72 and the transparent electrodes 111. Then, an Ag-containing layer 80 is coated over the Ru-containing layer 78. It is noted that the difference in material characteristics between the Ru-containing layer 78 and the Ag-containing layer 80 may result in different etching rates. Therefore, a beveled edge is formed on the bus electrodes after etching process because the Ag-containing layer 80 extends out from the Ru-containing layer 78. The beveled edge may cause peeling at the two ends of the bus electrodes when performing thermal processes as shown in FIG. 6.

To avoid peeling, the coating area of Ru-containing layer 78 is larger than the coating area of the Ag-containing layer 80 in the present invention. Both sides, region 900 and region 902, of the Ru-containing layer 78 are not covered by the Ag-containing layer 80 after coating with the Ag-containing layer 80. In other words, the region 900 and 902 of the Ru-containing layer 78 are still exposed. Then, a photolithography process is performed. If the length of the Ru-containing layer 78 is D in the x direction and the length of the Ag-containing layer 80 is c in the x direction, the exposed length in the x direction must be larger than or equal to length c.

Even though the etching rate of the Ru-containing layer 78 is higher than the etching rate of the Ag-containing layer 80, the area difference in the extended regions 900 and 902 between the two layers makes the length of the Ru-containing layer 78 greater than or equal to the length of the Ag-containing layer 80 after the photolithography process. Such manufacturing method avoids the Ag-containing layer 78 extending out from the Ru-containing layer 80. Therefore, the Ag-containing layer 78 is preferably adhered to the transparent electrodes.

Figure 9B:
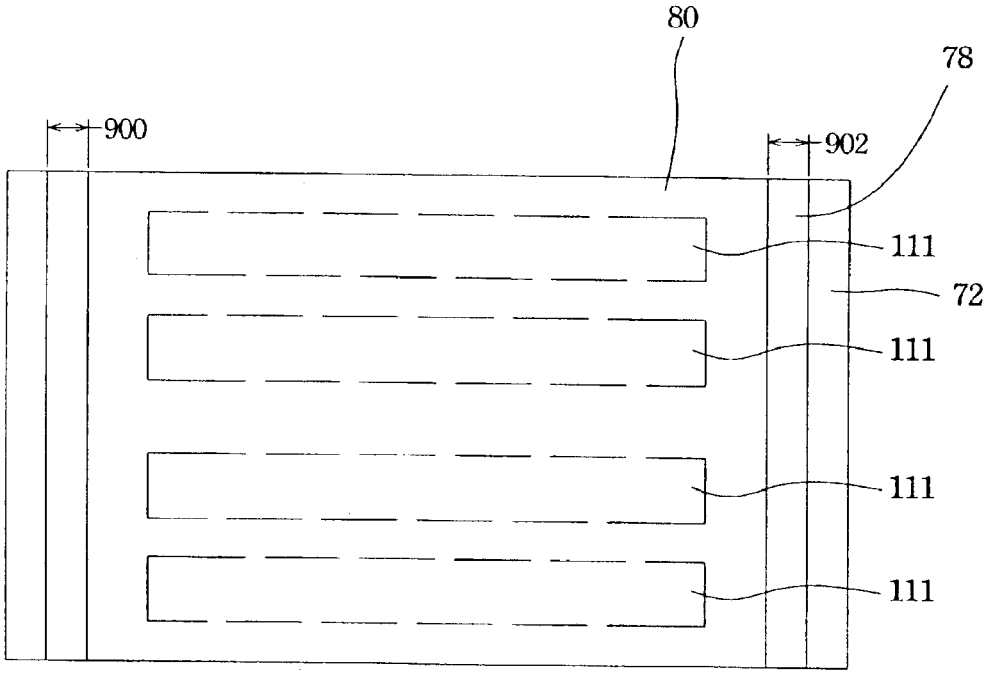
FIG. 9B is a schematic top view of FIG. 9A.

FIG. 9B is a schematic, top view of FIG. 9A. The Ru-containing layer 78 and the Ag-containing layer 80 cover the transparent electrodes 111. However, the Ru-containing layer 78 is not covered by the Ag-containing layer 80 in the regions 900 and 902. Such regions 900 and 902 avoid the beveled edge at the two ends of the bus electrodes even though the etching rate of the Ru-containing layer 78 is larger than the etching rate of the Ag-containing layer 80. Therefore, the Ag-containing layer 78 is preferably adhered to the transparent electrodes after the photolithography process.

Next, a dielectric layer is formed over the transparent plate 72, transparent electrodes 111 and bus electrodes 112. Finally, a protection layer is formed over the dielectric layer and the front substrate is complete.

As is understood by a person skilled in the art, the foregoing preferably embodiments of the present invention are illustrative rather than limiting of the present invention. They are intended to cover various modifications and similar arrangements included within the spirit and scope of the appended claims, the scope of which should be accorded the broadest interpretation so as to encompass all such modifications and similar structure.

What is claimed is:

1. A method for manufacturing bus electrodes of a plasma display panel, wherein said bus electrodes are built in a front substrate of said plasma display panel and a plurality of transparent electrodes are arranged in a first direction, comprising:

coating a Ru-containing layer over said front substrate and said plurality of transparent electrodes;

coating an Ag-containing layer over said Ru-containing layer, wherein a coating area of said Ag-containing layer is less than a coating area of said Ru-containing layer to expose a surface of said Ru-containing layer located on both sides of said front substrate;

patterning said Ru-containing layer and said Ag-containing layer to define bus electrodes; and developing said Ru-containing layer and said Ag-containing layer.

2. The method for manufacturing bus electrodes of a plasma display panel according to claim 1, wherein a material of said front substrate is glass.

3. The method for manufacturing bus electrodes of a plasma display panel according to claim 1, wherein when patterning said Ru-containing layer and said Ag-containing layer, an exposed length in said first direction is larger than a length of said Ag-containing layer is said first direction.

4. The method for manufacturing bus electrodes of a plasma display panel according to claim 1, wherein when patterning said Ru-containing layer and said Ag-containing layer, an exposed length in said first direction is less than or equal to a length of said Ag-containing layer is said first direction.

5. A method for manufacturing bus electrodes of a plasma display panel, wherein said plasma display panel at least comprises a front substrate, the method comprising:

forming a plurality of transparent electrodes arranged in a first direction over a front substrate;

coating a Ru-containing layer over said front substrate and said plurality of transparent electrodes;

coating an Ag-containing layer over said Ru-containing layer, wherein a coating area of said Ag-containing layer is less than a coating area of said Ru-containing layer to expose a surface of said Ru-containing layer located on both sides of said front substrate;

patterning said Ru-containing layer and said Ag-containing layer to define bus electrodes; and developing said Ru-containing layer and said Ag-containing layer.

6. The method for manufacturing bus electrodes of a plasma display panel according to claim 5, wherein a material of said front substrate is glass.

7. The method for manufacturing bus electrodes of a plasma display panel according to claim 5, wherein when patterning said Ru-containing layer and said Ag-containing layer, an exposed length in said first direction is larger than a length of said Ag-containing layer is said first direction.

8. The method for manufacturing bus electrodes of plasma display panel according to claim 5, wherein when patterning said Ru-containing layer and said Ag-containing layer, an exposed length in said first direction is less than or equal to a length of said Ag-containing layer is said first direction.

9. A method for manufacturing bus electrodes of a plasma display panel, wherein said bus electrodes is built in a front substrate of said plasma display panel and a plurality of transparent electrodes is arranged in a first direction, comprising:

coating a first layer over said front substrate and said plurality of transparent electrodes;

coating a second layer over said first layer, wherein a coating area of said second layer is less than a coating area of said first layer to expose a surface of said first layer located on both sides of said front substrate;

patterning said second layer and said first layer to define bus electrodes; and developing said first layer and said second layer.

10. The method for manufacturing bus electrodes of plasma display panel according to claim 9, wherein a material of said front substrate is glass.

11. The method for manufacturing bus electrodes of a plasma display panel according to claim 9, wherein said first layer is a Ru-containing layer.

12. The method for manufacturing bus electrodes of a plasma display panel according to claim 9, wherein said second layer is an Ag-containing layer.

13. The method for manufacturing bus electrodes of a plasma display panel according to claim 9, wherein when patterning said first and second layers, an exposed length in said first direction is greater than a length of said second contained layer in said first direction.

14. The method for manufacturing bus electrodes of a plasma display panel according to claim 9, wherein when patterning said first and second layers, an exposed length in said first direction is less than or equal to a length of said second layer is said first direction.

* * * * *